United States Patent [19]

Supra

[11] Patent Number: 4,849,024

[45] Date of Patent: Jul. 18, 1989

[54] POOL CLEANER

[75] Inventor: Carl F. W. Supra, Randburg, South Africa

[73] Assignee: Liberty Pool Products S.A., Geneva, Switzerland

[21] Appl. No.: 153,201

[22] Filed: Feb. 8, 1988

[30] Foreign Application Priority Data

Jan. 7, 1988 [ZA] South Africa ..... 88/0083
Jan. 14, 1988 [ZA] South Africa ..... 88/0237
Jan. 19, 1988 [ZA] South Africa ..... 88/0327

[51] Int. Cl.[4] ..... B08B 7/00

[52] U.S. Cl. ..... 134/21; 15/1.5 R; 15/1.7; 210/169; 210/242.1; 210/416.1; 210/525; 134/22.1; 134/22.12

[58] Field of Search ..... 134/21, 22.1, 22.12; 15/1.5; 210/242.1, 169, 416.1, 525

[56] References Cited

U.S. PATENT DOCUMENTS 3,229,315 1/1966 Watson ..... 15/1.5
3,790,979 2/1974 Foster ..... 15/1.7
3,822,754 7/1974 Henkin et al. ..... 15/1.7
4,401,576 8/1983 Meurer ..... 210/525

FOREIGN PATENT DOCUMENTS 1203836 9/1970 United Kingdom ..... 15/1.5

*Primary Examiner*—Asok Pal
*Attorney, Agent, or Firm*—Jones, Tullar & Cooper

[57] ABSTRACT

A swimming pool cleaner which has a housing to which suction is applied via a flexible hose. Water flow through the housing is used to drive a turbine which powers a propeller to cause movement of the housing. The buoyancy of the housing is adjusted by filling a chamber, of the housing, with water. The hose is permitted to rotate, and pivot, relatively to the housing to increase the mobility of the cleaner.

10 Claims, 2 Drawing Sheets

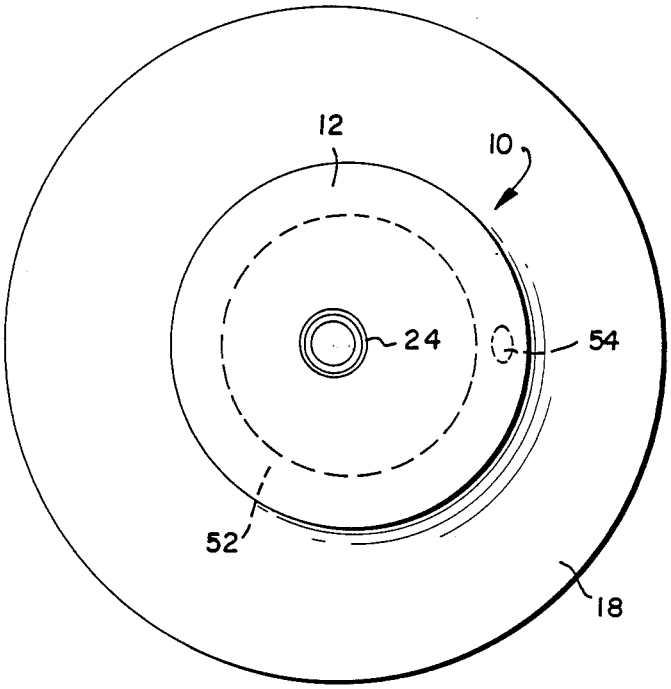
FIG. 2
FIG. 3
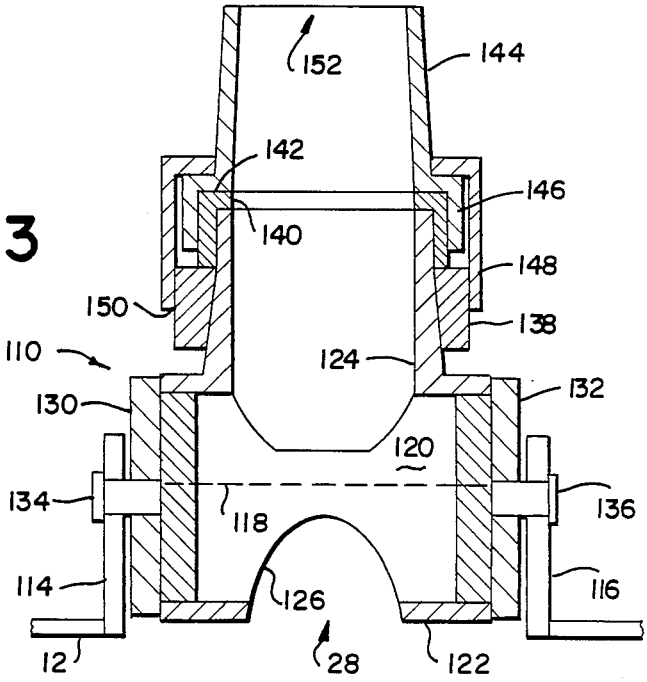

POOL CLEANER

BACKGROUND OF THE INVENTION

This invention relates to a device for cleaning a surface submerged in a liquid and to a method of cleaning such a surface.

SUMMARY OF THE INVENTION

The invention provides a device for cleaning a surface submerged in a liquid which includes a head with at least one inlet which opposes the surface and to which, in use, suction is applied thereby to cause liquid to flow through the inlet, and propulsion means which is powered by the flowing liquid and which causes movement of the head over the surface.

The propulsion means may include a turbine, wheel or like apparatus which is caused to move by the liquid flow and which may be used to drive a propeller or similar implement which propels the head over the surface.

The propeller means may be inclined or oriented at any suitable angle relatively to the head. A liquid outlet from the housing may similarly be inclined or oriented at any suitable angle relatively to the head.

Viewed in plan the housing may be substantially circular or symmetrical and the propeller means, in one embodiment of the invention, may be aligned more or less tangentially to the housing. The outlet from the housing may be centrally positioned relatively to the housing.

The housing may contain or have attached to it floats, weights or other devices which are adapted to give the housing a desired buoyancy in the liquid. In one form of the invention the housing includes one or more pockets or chambers which are filled with the liquid thereby to adjust the buoyancy of the cleaning device, which may for example constitute a cleaner for cleaning a swimming pool.

The use of water permanently to fill a chamber associated with the body of a pool cleaner means that it is no longer possible for the "interior" of the body to be completely void of water. Consequently if the pool cleaner should break through the surface of the water in the swimming pool the mass of water, within the sealed chamber, prevents the body from rising too far out of the water and the likelihood of the suction pump running dry is much diminished.

In accordance with this aspect of the invention, therefore, there is provided a pool cleaner which includes a body with a cleaning head which is connected to a flexible suction hose, and means for causing the body to move over a submerged surface which is to be cleaned by the cleaning head, the body including at least one sealed chamber which is a least partly filled with water.

Preferably the chamber is entirely filled with water.

In one embodiment of the invention the chamber is located at a peripheral portion of the body and, preferably, extends continuously around the periphery.

The body preferably has a circular outline or a symmetrical ouline, when viewed in plan, and the suction hose is centrally positioned relatively thereto.

In place of a single continuous peripheral chamber a plurality of separately-filled sealed water chambers could be employed.

Water may be admitted into each chamber through a one-way valve or the like.

The housing may be made from any suitable material and preferably is made from a plastics material. The housing may include a flexible skirt or the like which preferably extends around the inlet and which is adapted to assist the housing in keeping in suction contact with the submerged surface.

In one form of the invention the cleaning device includes a housing, an inlet to the housing, an outlet from the housing, a liquid flow path extending from the inlet to the outlet, turbine means located in the liquid flow path, and propeller means which is driven by the turbine means.

The outlet may be connected to a flexible hose. The outlet may be defined by a spigot or similar device which may be movable relatively to the housing, i.e. the device may be pivotal, rotatable or swivellable relatively to the housing.

The inlet to the housing may define a suction inlet which opposes the surface. When liquid flows in the liquid flow path the housing may be caused to adhere to the surface in the liquid.

The invention also extends to a method of cleaning a surface submerged in a liquid which includes the steps of locating a cleaning head opposing the surface, applying suction to the head thereby to cause the head to adhere to the surface and to cause liquid to flow through the head, the flowing liquid being used to drive propeller means, and using the propeller means to propel the head over the surface.

The hose which is connected to the cleaning head is flexible, but only to a limited extent. This can lead to problems when the cleaner is used in a swimming pool which has sharp corners for example at the junction of the floor of the swimming pool and its side walls, or in corners formed where side walls of the swimming pool meet. The difficulty arises in that, as the cleaning head advances over the submerged surface, the hose may be brought into contact with a side wall, for example, and because of its limited flexibility cause the cleaning head to alter course with the result that certain portions of the submerged surface remain uncleaned.

Under other conditions the limited flexibility of the suction hose can cause the cleaning head to become jammed at one location. Apart from the fact that the swimming pool is then not properly cleaned the swimming pool surface can be damaged.

To avoid the aforementioned problem the invention provides a swimming pool cleaner which includes a housing with a head for cleaning a submerged surface and a coupling with a connector which connects the housing to a suction hose, the connector having at least two degrees of freedom of movement relatively to the housing.

The connector may be rotatable, in a first sense, at least to a limited extent reatively to the housing. Thus the connector may be rotatable about its longitudinal axis.

The connector may include a spigot which is insertable into the suction hose.

The connector may include a peripheral formation such as an annular projection, a shoulder or the like, which is held loosely captive between opposed surfaces of components of the coupling.

The connector may be rotatable in a second sense, at least to a limited extent, relatively to the housing.

In one form of the invention the coupling includes a first tubular member which extends laterally, second tubular member which projects from the first tubular member, an inlet being formed through the first tubular member, an outlet from the coupling being formed at a free end of the second tubular member, mounting means which permits pivotal movement of the coupling relatively to the housing about a longitudinal axis of the first tubular member, and hose connecting means which is engaged with the free end of the second tubular member and which is rotatable relatively thereto about a longitudinal axis of the second tubular member.

The invention also provides a coupling for a swimming pool cleaner which includes a body, a passage through the body, an inlet to the passage, an outlet from the passage, means for connecting the outlet to a flexible suction hose, the connecting means permitting the hose to rotate about its longitudinal axis relatively to the body, and means for pivotally mounting the connector to a body of the pool cleaner.

The body may have an inverted T-shape with a cross piece of the T having the inlet formed in it and the mounting means located at opposed ends of the cross piece.

The outlet may be formed at a free end of an upright piece of the T-shaped body. The connecting means may include a hose connector and union means for rotatably connecting the hose connector to the body.

BRIEF DESCRIPTION OF THE DRAWINGS

The invention is further described by way of example with reference to the accompanying drawings in which:

FIG. 2 is a simplified plan view of a modified pool cleaner, and FIG. 3 shows in cross section and from the side a coupling for use with the pool cleaner.

DESCRIPTION OF PREFERRED EMBODIMENT

Figure 1:
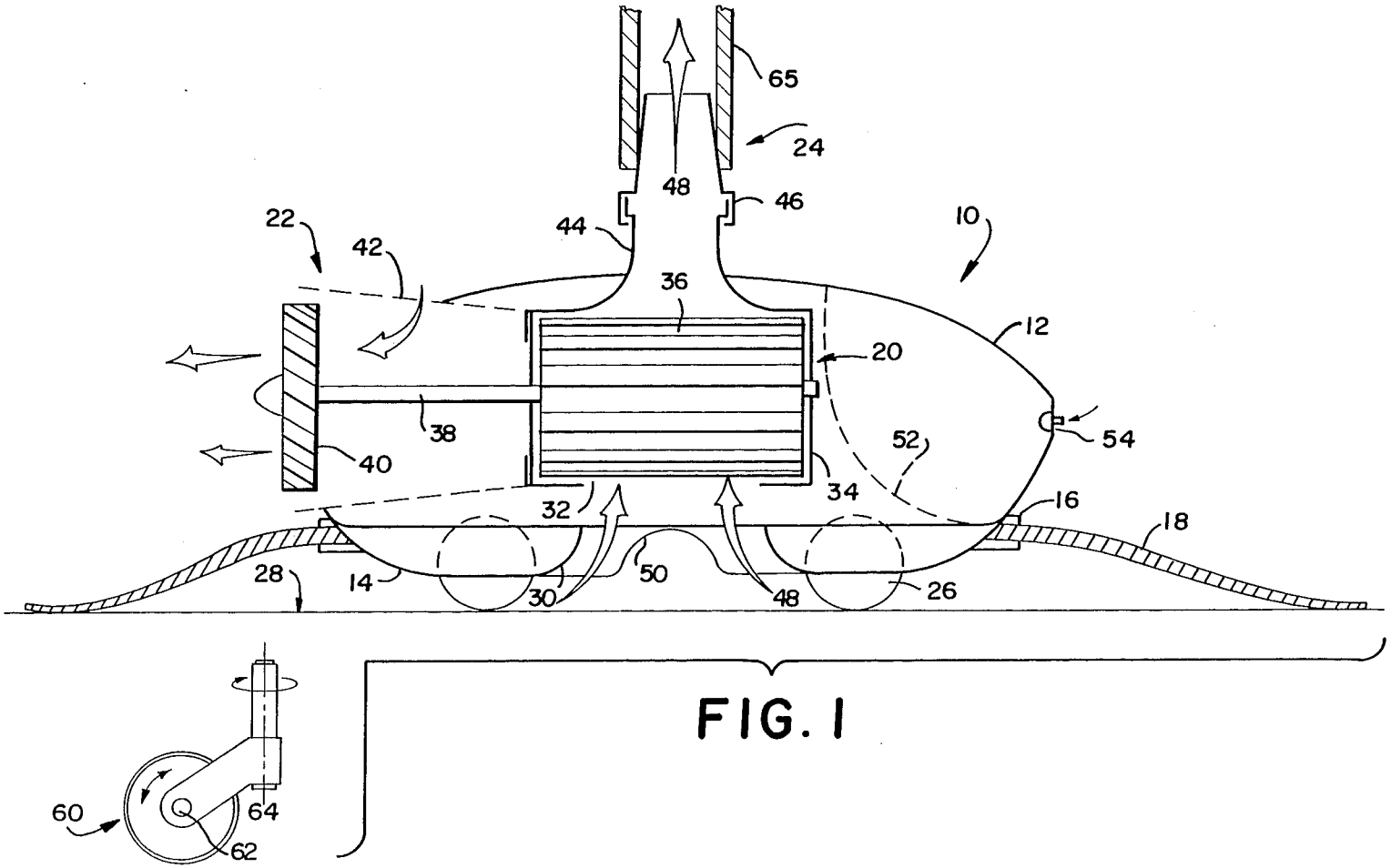
FIG. 1 illustrates from the side and in cross section a pool cleaning device according to one embodiment of the invention.

FIG. 1 illustrates from the side and in cross section a pool cleaning device 10 according to one embodiment of the invention. The device includes a moulded plastics housing 12 with an undersurface 14, an external locating formation 16 which extends around the housing 12, a flexible skirt 18 which is engaged with the formation 16, a turbine 20 which is mounted inside the housing 12, a propulsion system 22 which is connected to the turbine and which projects from the housing 12, and an outlet 24 from the housing.

The undersurface 14 has a plurality of freely rotatable captive balls 26 mounted to it. These balls rest on and ride over a submerged surface 28 which is to be cleaned by the device. Such a surface is formed for example by a surface of a swimming pool. As an alternative to the balls use may be made of castors of the kind shown in the inset drawing. This type of castor 60 can rotate about a first axis 62 which in turn is offset with regard to a vertical axis 64 about which the castor can pivot. This type of "trailing" wheel can therefore accommodate movement of the cleaner in any direction.

An inlet 30 is formed in the undersurface and permits water to flow to an inlet 32 in a casing 34 of the turbine. Mounted inside the casing is a turbine rotor 36. The inlet 32 is positioned so that the water flow tangentially strikes the turbine rotor 36.

The propulsion system 22 includes a shaft 38 which is connected to an axle of the turbine rotor 36. A propeller 40 is mounted to the free end of the shaft 38. A mesh cape 42 surrounds the shaft 38 and the propeller 40 protecting these components while at the same time permitting a free flow of water around the shaft.

Viewed in plan the propulsion system 22 may be centrally positioned relatively to the housing 12 but preferably is offset or inclined so that in use the propulsive force generated by the propeller 40 imparts a forward and a rotational movement to the housing 12.

The turbine casing 34, at its upper end, leads to an outlet duct 44 which is connected to the outlet connection 24 by means of a swivel joint 46.

In use, as seen in FIG. 1 the device 10, as has been indicated, is located on a submerged surface 28 of a swimming pool. A flexible hose 65 is connected to the outlet 24 and extends to a suction point, for example in a weir of the swimming pool, located in the filtration system of the swimming pool. Water is circulated, in a conventional manner, by means of a pump-driven motor, not shown, and consequently suction is applied to the housing 12 so as to cause water to flow through the inlet 30 of the housing, through the turbine 20 and to the outlet 24. The water flow path is indicated by means of arrows 48.

The water flowing through the turbine causes the turbine rotor to rotate. This in turn causes the propeller 40 to rotate and a propulsive force is thereby exerted on the housing 12. The housing is thus caused to move across the submerged surface 28 of the swimming pool.

The water which flows into the housing 12 through the inlet 30 entrains foreign material which has settled on the surface 28. This water and the foreign material is directed to the filter of the swimming pool where the foreign material is trapped and the water is returned to the swimming pool.

As has been indicated the propulsion system 22 is preferably slightly offset, when viewed in plan, so that a degree of rotational movement is imparted to the housing 12. The swivel joint 46 between the housing 12 and the flexible suction hose enables this type of rotational movement to be accommodated. The result is that the cleaning device 10 moves in a random manner across the submerged surface 28 ensuring that, with the passage of time, substantially the entire submerged surface is cleaned.

The balls 26 on the undersurface 14 minimise frictional effects between the cleaning device and the surface 28 and ensure that the cleaning device can move freely over the surface. The flexible skirt 18 assists the cleaning device in adhering to the submerged surface 28 and in this way an efficient cleaning action takes place. Under certain conditions it may be found that the suction is in fact so great that the propeller 40 is unable to displace the cleaning device across the surface 28. This can be countered in a variety of ways for example by forming the flexible skirt 18 with formations on its undersurface which ensure that a very tight seal against the surface 28 does not occur; by forming holes through the flexible skirt 18 at strategic positions; or by forming a by-pass water passage through the housing 12 to the turbine 20 on the upper side of the skirt 18.

It is also possible to dispense with the skirt and to have the cleaning device 10 riding on the balls 26 only or, in fact, to dispense with the balls 26 as well in which event the undersurface 14 rests directly on the submerged surface 28. In this last mentioned case recesses 50, as may be seen in FIG. 1, are formed in the undersurface so that water can flow to the turbine 20. Obviously it is desirable, for this embodiment, to form the undersurface 14 from a highly abrasion-resistant material.

It has been found that the pool cleaner, as is the case with certain other types of cleaners, can climb vertical walls of a swimming pool at least until part of the pool cleaner breaks through the water surface and is exposed to atmosphere. When this occurs all the water in the housing of the cleaner can be drawn out by the suction effect and replaced by air. The pool cleaner then floats on the water surface of the swimming pool and air is continuously drawn into the suction system. This can lead to damage to the motor of the pump used in the suction or filtration system of the swimming pool. For example, referring to the illustrated embodiment of FIG. 1, if the pool cleaner housing breaks through the water surface and the inlet 30 is exposed to atmosphere then any water inside the housing is immediately sucked through the outlet 24. The housng then becomes air-filled, and floats on the water surface with the result that the suction system becomes completely filled with air.

Consequently, it is necessary to establish the buoyancy of the cleaning device 10, to a certain extent at least, through trial and error. It may for example be necessary to add weights to the cleaner 10 or to form the housing 12 with air pockets. A particularly important technique of altering the bouyancy of the cleaning device 10 involves the formation of at least one chamber 52 in the housing, indicated by means of dotted lines as seen in FIG. 2.

The chamber 52 is permanently filled with water which is admitted into the chamber through a one-way valve 54. The size of the chamber 52 varies according to requirements with the objective being to create a mass in the housing which does not interfere with normal movement of the housing but which, when the housing breaks through to atmosphere is sufficiently heavy to prevent the housing from rising to such a height above the water level that air can replace all the water within the inlet 30. Exactly the same considerations apply if for example the pool cleaner is of a type which has two or more inlets, for driving more than one turbine or other, similar, device.

The use of a permanently water-filled chamber to achieve the aforementioned objective has the advantage that, when the housing 12 is fully immersed, its operation is not affected in any way when compared to a cleaner which does not include a water-filled chamber. In each instance the interior of the housing 12 is filled with water. However when the cleaner of the present invention as depicted in FIG. 2 breaks through the water level in the pool it is only that water not contained within the chamber 52 which drains from the housing. The more the housing 12 attempts to rise above the swimming pool level the greater is the mass of water within the chamber which must be raised above the water level. This regulating mechanism ensures that the pool cleaner settles back into the swimming pool water and although a small quantity of air may be drawn through the suction hose connected to the outlet 24 no substantial negative effects are caused.

The chamber 52 preferably extends completely around the periphery of the cleaner, as shown in plan in FIG. 2, so that substantially the same effect is achieved irrespective of which side of the housing first breaks through the water surface.

This aspect of the invention has been described with reference to the use of turbine-drive propulsion systems. A pool cleaner employing such a drive system normally has a rather large body with internal formations to channel water past a turbine. For this reason the problems described herein are more likely to manifest themselves. However cleaners which make use of different drive systems may, depending upon the geometrical construction of the cleaning head, also run into these problems. It is apparent therefore that this aspect of the invention although particularly applicable to turbine-driven type pool cleaners is not limited in its application to this type of cleaner only.

The cleaning device 10 is a compact, silent and highly efficient mechanism. The propeller 40 propels the device at a high speed and in a random manner across the submerged surface 28. It is found that the propulsion is not affected by the nature of the surface 28 and that the cleaning device can be used with fiberglass and with vinyl pools. The tangential orientation of the propulsion system and the centrally located swivel joint 46 of the outlet means that the cleaner is able to extricate itself from sharp corners, step formations and the like and so does not become jammed in one position.

The swivel joint 46 shown in FIG. 1 can however be replaced by a coupling 110, of the type shown in FIG. 3, which offers further freedom of movement of the suction hose relatively to the housing.

As may be seen in FIG. 3, the housing 12 of the pool cleaner includes two opposed pedestals 114 and 116 and a semi-cylindrical shroud, which is indicated by means of a dotted line 118, and which extends upwardly from the body on opposed sides of the coupling 110.

The coupling 110 includes an inverted T-shaped body 120 with a lateral tubular member 122 and an upright tubular member 124 extending from the member 122. The tubular member 122 fits closely yet rotatably within the semi-cylinder 118. An inlet 126 is formed through a lower portion of the tubular member 122 and permits water flow 128 from within the interior of the body 112 of the cleaner to the interior of the T-piece 120.

Opposed ends of the lateral member 122 have plugs 130 and 132 respectively engaged therewith. These plugs seal the body 120 and are engagable with fixing pins 134 and 136 respectively which pass through the pedestals 114 and 116 so that the T-piece 120 is mounted to the housing 12 and is pivotally movable relatively to the housing about a longitudinal axis of the lateral member 122.

The upright member 124 is externally tapered and a collar 138 is frictionally engaged with the member 124 at a lower end thereof. A ring cap 140 with an enlarged flat annular end 142 is frictionally engaged with the outer end of the member 124. A slightly tapered hose connector 144 with an enlarged mouth 146 is located around the ring cap 140 and a union cap 148 is used to fix the hose connector to the T-piece 120. The union cap 148 frictionally engages with the collar 138 at a location 150 in such a way that the enlarged mouth 146 of the hose connector 144 is held loosely captive between opposed surfaces of the ring cap 140 and the union cap 148 and consequently the hose connector is rotatable relatively the T-piece 120 about its longitudinal axis.

A flexible suction hose, not shown, is engaged with the hose connector which is inserted, spigot-like, into an end of the hose for this purpose.

The flexible suction hose is used to apply suction to the interior of the housing 12 of the cleaner. Water flows into the T-piece as indicated by the arrows 128 and exits into the suction hose as indicated by an arrow 152.

If the housing 12 strikes any impediment to its movement, within the swimming pool, then the hose is able to take up an appropriate attitude or orientation relatively to the housing 12 by virtue of the fact that the T-piece is rotatable about the axles 134 and 136 and due to the face that the hose connector 144 can rotate about its longitudinal axis relatively to the T-piece.

The coupling 110 moves readily and easily relatively to the housing 12 and consequently the possibility that the hose will prevent certain portions of the submerged surface of the swimming pool from being properly cleaned is much reduced. Similarly the possibility that the cleaner will become jammed, stationary, at a location within the pool is also reduced.

I claim:

1. A swimming pool cleaning device for cleaning a surface that is submerged in a liquid, said submerged surface cleaning device comprising:

a head having at least one inlet which opposes the surface to be cleaned:

means to apply suction to said head to cause liquid to flow through said inlet; and propulsion means which includes a turbine which is powered by the flowing liquid, and propellor means which is driven by the turbine and which causes movement of said head over the surface to be cleaned.

2. A device according to claim 1 wherein the propeller means is aligned, relatively to the head, to impart rotational movement to the head.

3. A device according to claim 1 wherein the head comprises a housing which contains a chamber and one way valve means for admitting liquid into the chamber.

4. A device according to claim 3 wherein the chamber extends peripherally around the housing.

5. A device according to claim 1 wherein the head comprises a housing which is formed with an outlet, and which includes coupling means for connecting the outlet to a flexible suction hose, so that the hose is pivotal, rotatable and swivellable relatively to the housing.

6. A device according to claim 5 wherein the coupling means includes a first tubular member which extends laterally, a second tubular member which projects from the first tubular member, an inlet being formed through the first tubular member, an outlet from the coupling being formed at a free end of the second tubular member, mounting means which permits pivotal movement of the coupling relatively to the housing about a longitudinal axis of the first tubular member, and hose connecting means which is engaged with the free end of the second tubular member and which is rotatable relatively thereto about a longitudinal axis of the second tubular member.

7. A method of cleaning a swimming pool surface that is submerged in a liquid which includes the steps of:

locating a cleaning head opposing the surface to be cleaned;

applying suction to said head, causing said head to adhere to the surface and causing liquid to flow through said head;

using said flowing liquid to drive a propellor means; and using said propellor means to propel said head over the surface to be cleaned.

8. A method according to claim 7 which includes the step of adjusting the buoyancy of the head by introducing a volume of the liquid into a sealed chamber of the cleaning head.

9. A method according to claim 7 wherein the suction is applied to the head through a hose and which includes the steps of mounting the hose to the head so that the hose can rotate about a longitudinal axis relatively to the head, and pivot about a transverse axis relatively to the head.

10. A device for cleaning a surface submerged in a liquid, said surface cleaning device having a head with at least one inlet which opposes the surface, means to apply suction to said head to cause liquid to flow through said inlet, propulsion means powered by said flowing liquid for effecting movement of said head over the surface to be cleaned, and at least one outlet in said head, said outlet including a coupling for connecting said outlet to a flexible swivel hose, said coupling means including a first tubular member which extends laterally, a second tubular member which projects from said first tubular member, an opening inlet being formed through the first tubular member, a discharge outlet from said coupling being formed at a free end of said second tubular member, mounting means which permits pivotal movement of said coupling relatively to said head about a longitudinal axis of said first tubular member, and hose connecting means which is engaged with said free end of said second tubular member and which is rotatable relatively thereto about a longitudinal axis of said second tubular member.

* * * * *